United States Patent [19]

Hanyu et al.

[11] 4,368,681

[45] Jan. 18, 1983

[54] PATTERN SELECTING MECHANISM OF A SEWING MACHINE

[75] Inventors: Susumu Hanyu, Hachioji; Shuzo Morimoto, Hino; Yasuro Sano, Hachioji, all of Japan

[73] Assignee: Janome Sewing Machine Co. Ltd., Tokyo, Japan

[21] Appl. No.: 178,706

[22] Filed: Aug. 12, 1980

[30] Foreign Application Priority Data

Aug. 16, 1979 [JP] Japan ..... 54-112055

[51] Int. Cl.[3] ..... D05B 3/02

[52] U.S. Cl. ..... 112/158 A

[58] Field of Search ..... 112/158 A, 158 D, 158 R

[56] References Cited

U.S. PATENT DOCUMENTS 4,106,419 8/1978 Fresard ..... 112/158 A 4,313,389 2/1982 Hanyu et al. ..... 112/158 A

*Primary Examiner*—Peter P. Nerbun

*Attorney, Agent, or Firm*—Michael J. Striker

[57] ABSTRACT

A sewing machine produces patterns of stitches including straight stitches, in which a single operating dial is manually operated to select one of the patterns with a proper feeding amount in one rotation range thereof, and to vary feeding movement with a specific cycle in relation to the same patterns in another rotation range thereof to produce so called "super patterns".

7 Claims, 9 Drawing Figures

5 4 3 2 1 0 M
85
52
4
7
24a
17b
9
86
14
20
26
28
53
27
29
24
25
23
22
51
47
84
I
II
85
86
84b
84a
83
16
14

PATTERN SELECTING MECHANISM OF A SEWING MACHINE

DESCRIPTION OF THE INVENTION

The invention relates to a pattern selecting mechanism of such a sewing machine in which the single operating dial is manually operated in one rotation thereof to vary the feeding movement with a specific cycle in relation to the patterns, thereby to produce further different patterns to meet the requirements of the machine users.

There have heretofore been proposed such a sewing machine in which a dial is rotated through a plurality of angular positions. However, it was absolutely impossible to vary the fabric feed with a specific cycle in one rotation range for producing many kinds of the super patterns.

The present invention has been devised to eliminate disadvantages in the prior art. It is a basic object of the invention to provide a device which is easy in operation.

It is another object of the invention to provide a device which may produce various kinds of the super patterns of stitches.

Many other features and advantages of the invention will be apparent from the following description of the invention in reference to the attached drawings.

DETAILED DESCRIPTION OF THE INVENTION

Figure 1:
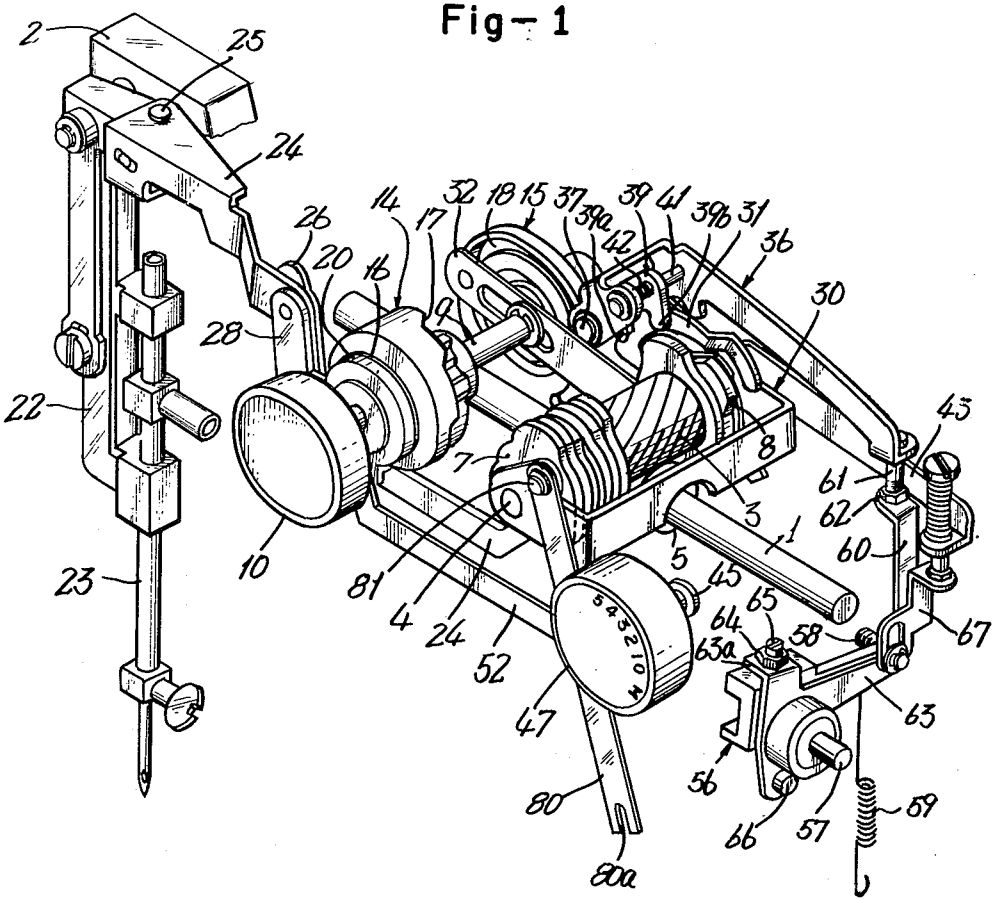
FIG. 1 shows a perspective view of relative mechanism housed in a top of a sewing machine.

The invention will be discussed in reference to the attached drawings. The numeral 1 shows a main shaft rotatably supported in a machine housing 2. The numeral 3 is a worm wheel which is mounted on a shaft 4 mounted in the machine housing 2 transverse to with the main shaft 1, and which is in mesh with a worm 5 secured on the main shaft 1 for reducing rotation thereof 1/integer of rotation of the main shaft 1 (in this embodiment, reduction is 1/6). The numerals 7 and 8 are pattern cam group 7*a*, 7*b*. . . for changing the amplitude of the needle bar 23 and the feed changing cams 8*a*, 8*b* . . . , those being formed integrally with the worm wheel. The numeral 9 denotes a selecting dial shaft rotatably supported in the machine housing 2. The numeral 10 designates a pattern selecting dial fixed to the selecting dial shaft 9 at its end portion disposed outside of the machine housing 2. The dial 10 is arranged such that it can be rotated to an exact position by association with a selecting plate 11 formed with a plurality of cutouts 11*a* on its periphery, which is fixed to the machine housing 2, a setting pin 12 which is held within the pattern selecting dial 10 and can engage in any selected cutout 11*a*, and a setting spring 13 pressing the pin 12.

The pattern selecting dial 10 can be rotated through a plurality of angular positions, and in this embodiment it can be rotated through a first range of angular positions and a second range of angular positions following the first range.

Figure 5:
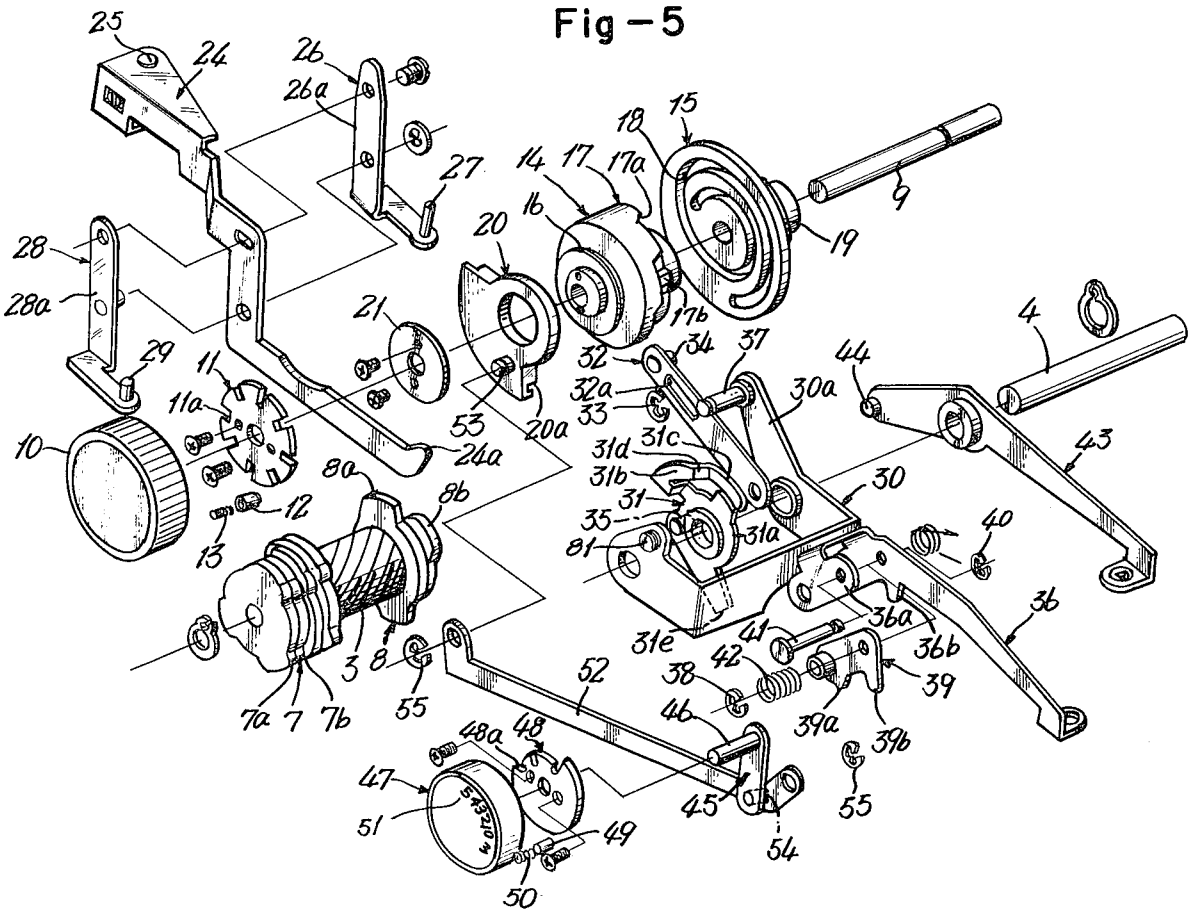
FIGS. 5 and 6 show perspective exploded views of relative mechanism.

The numerals 14 and 15 denote respectively a cylindrical pattern cam selecting cam body and a feed setting disk cam body which are fixedly mounted on the pattern dial shaft 9 inwardly of the machine housing 2. The pattern cam selecting cam body 14 is provided at its front side with a drum 16 for winding a later mentioned string 86 thereon, and on its rear side with a pattern selecting cam 17 having a side cam face 17*a* inclined in an axial direction, stepped side a cylindrical cam face 17*b* extending in a radial direction (FIG. 5). The feed setting disk cam body 15 is provided with a super pattern selecting cam 18 comprising a spiral groove at its front side, and with a button hole stitching cam 19 having a cam face extending in a radial direction at its rear side.

The shape of the super pattern selecting cam 18 will be explained in detail with reference to FIG. 7. With respect to a first rotation range of the pattern selecting dial 10, the feed setting cam body 15 is formed with a large radius cam groove portion 18*a* of constant radius in such a manner that a later mentioned switching arm 32 (refer to FIG. 5) engaging the super pattern selecting cam 18 is maintained at the left-most position thereof. With respect to a second rotation range, a small radius cam groove portion 18*b* is formed following the large radius cam groove portion (FIG. 7) 18*a* in such a manner that the switching arm 32 is maintained at the right-most position thereof. The numeral 20 in FIG. 5 designates an amplitude control cam body provided with an amplitude control cam face 20*a* which is pivoted to the winding drum 16 of the pattern cam selecting cam body 14 via a seat plate 21.

The numeral 22 is a needle bar supporter which is pivoted to the machine housing turnably to the right and left and supports a vertically movable needle bar 23 at its side. The numeral 24 is a needle bar turning arm which is pivoted at its one end to the needle bar supporter 22 by a pivot pin 25 having an axis coinciding with the axis of the needle bar 23, and whose follower 24*a* formed at the other end engages a desired cam of the cam group 7. The numeral 26 is a selection adjusting arm whose base 26*a* is fixed to a rear face of the needle bar turning arm 24, and a follower 27 projecting upwardly from its end engages the pattern selecting cam 17. The follower 17 is biased by a spring (not shown) to contact the pattern selecting cam 27. The numeral 28 is an amplitude adjusting arm whose base 28*a* is fixed to a front face of the needle bar turning arm 24, and a follower 29 projecting upwardly from its end engages a cam face 20*a* of the amplitude control cam body 20. The follower 29 is a biased by a spring (not shown) to contact the amplitude control cam face 20*a*. The numeral 30 is a U-shaped super pattern selecting arm which is mounted on the shaft 4 and holds the pattern cam group 7 and the feed changing cam group 8 inside thereof. The numeral 31 is a super pattern switching cam body mounted on the shaft 4 between a back side 30*a* of the supper pattern selecting arm 30 and the feed changing cam group 8. The cam body 31 is formed with a circumferentially extending cam 31*a* having axially offset cam faces 31*b*, 31*c* and an inclined cylinder face 31*d* therebetween. The 31*e* is an angular portion projecting from the lower end of the projection cam 31*a*. The numeral 32 is a switching arm and the selecting dial shaft 9 passes through an oblong slot 32*a* formed therein and the switching arm 32 is restrained in the axial direction by a snap ring 33. A follower 34 provided at one end of the switching arm 32 engages the super pattern selecting cam 18, and the other end of the switching arm 32 is mounted on a pin 35 on the super switching cam 31 and is restrained in the axial direction by a snap ring (not shown). The numeral 36 is a feed adjusting arm which is pivoted at a base 36*a* on a pivot shaft 37 at the back side 30*a* of the super pattern selecting arm 30 and restrained against axial movement by a snap ring 38. The numeral 39 is a super pattern feeding pawl which is housed inside of the base 36*a* and is mounted on a shaft 41 by a snap ring 40 and is pushed backwardly by a compression spring 42 of weak pressure. A projecting piece 39*a* at the lower part of the pawl 39 is adapted to engage the supporting faces 31*b*, 31*c*, and the follower 39*b* is adapted to engage the feed adjusting cam group 8. The numeral 43 is a feed setting arm mounted on the shaft 4, a pin 44 of which is engaged with the button hole stitching cam 19. Detailed description thereof is omitted because of no relation with the invention.

The numeral 45 is an amplitude adjusting plate which is transverse to the main shaft 1 and is provided with an amplitude dial shaft 46 rotatably supported in the machine housing. The numeral 47 is an amplitude dial fixed to an end of the amplitude dial shaft 46 projecting outside of the machine housing 2. The dial 47 is set such that it can be turned exactly by association of a switching plate 48 formed with a plurality of cutouts 48*a* on its periphery, which is fixed to the machine housing 2, a setting pin 49 which is held within the amplitude dial 47 and engages the cutouts 48*a* of the switching plate 48, and a setting spring 50 pressing the pin 49. The numeral 51 is an amplitude indicator at the front face of the amplitude dial 47. The numeral 52 is an amplitude arm which can be moved in axial direction by pivoting via a snap ring 55 one end thereof on a pin 53 provided at the front face of the amplitude control cam body 20 and by pivoting via a snap ring 55 the other end thereof on a pin 54 provided at a lower end of the amplitude control plate 45.

Figure 4:
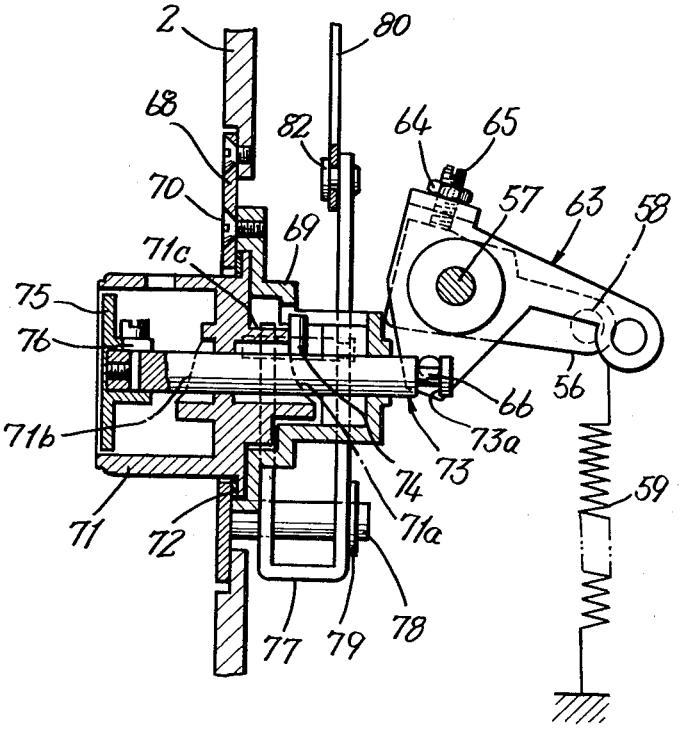
FIG. 4 shows a side view, partially in section, of a feed dial mechanism.

The numeral 56 is a feed adjuster rotating around a feed adjustor shaft 57 parallel with the main shaft 1. The numeral 58 is a feed adjusting pin provided at a rear end of the feed adjuster. The numeral 59 is a comparatively strong adjustor spring, which is positioned between the feed adjusting pin 58 and the machine housing 2, and biases the feed adjustor 56 to rotate to generate the maximum forward feed (i.e., in the clockwise direction in FIG. 4) around the feed adjustor shaft 57. The numeral 60 is a feed control arm which is fixed via a nut 62 to a feed control rod 61 connected at its upper end to the other end of the feed adjusting arm 36.

The numeral 63 is an adjustor rotating plate mounted on the feed adjustor shaft 57 adjacent to the feed adjustor 56, and an abutting screw 65 is set such that it contacts the feed adjustor 56 with a spring (not shown) of weak force, which screw 65 is secured by a nut 64 on a bent piece provided at the top of the adjustor rotating plate 63, and accordingly the adjustor rotating plate 63 is rotated integrally with the feed adjustor 56. The numeral 66 is a pin provided at the lower end of the adjustor rotating plate 63 to run in a circular groove 73*a* of a later mentioned feed dial shaft 73. The numeral 67 is a feed setting arm to connect the feed setting arm 43 and the adjustor rotating plate 63. Detailed description thereof is omitted because of no relation with the invention.

Figure 6:
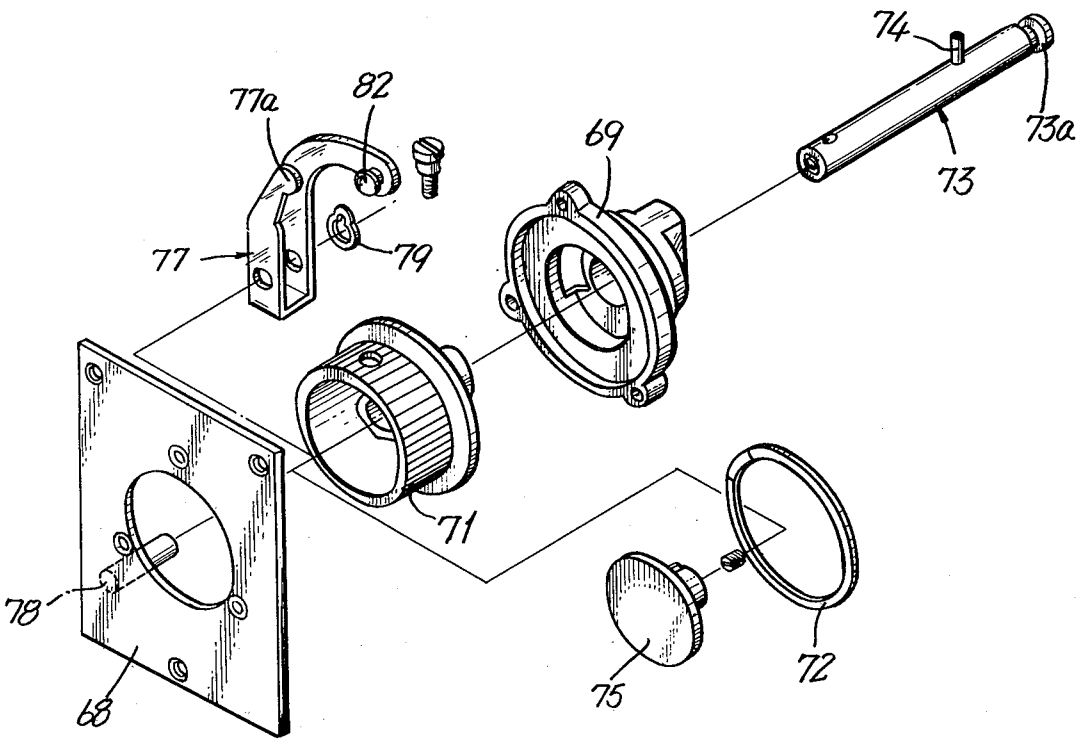

The numeral 68 (FIG. 4) is a feed dial plate secured to the machine housing 2. 69 is a feed dial seat fixed to a rear side of the plate 68 by a screw 70. 71 is a feed dial rotatably provided at a space defined between the feed dial plate 68 and the feed dial seat 69 via a spring washer 72. 73 is a feed dial shaft inserted along holes formed in axes of the feed dial seat 69 and the feed dial 71, and a circular groove 73*a* formed at one end of the shaft 73 is engaged by the pin 66 of the adjustor rotating plate 63, and a pin 74 provided on the shaft 73 is engaged with a forward feed controlling cam face 71*a* formed in the feed dial 71 by means of an adjustor spring 59, and the shaft 73 is provided at its other end with a reverse button 75 and a pin 76 projecting therefrom. 71*b* is a backword feed controlling cam face formed in the feed dial 71 be engaged by the pin 76. 77 is a U shaped pattern switching arm pivoted on a pivot shaft 78 at a rear face of the feed dial plate 68 and being restrained in the axial movement by a snap ring 79. 77*a* (FIG. 6) is a follower formed at an upper end of the arm 77, and the follower 77*a* engages the pattern switching cam 71*c* by means of an appropriate spring mechanism (not shown), which biases the arm 17 toward a circular surface which is formed in continuation to the forward feed controlling cam face 71*a* of the feed dial 71. 80 (FIG. 8) is a super pattern selecting rod which is pivoted at its upper end on a pin 81 provided on the super pattern selecting arm 30, and a fork 80*a* on its lower end is mounted on a stepping pin 82 provided on the upper end of the rear branch of the pattern switching arm 77.

Figures 2, 3:
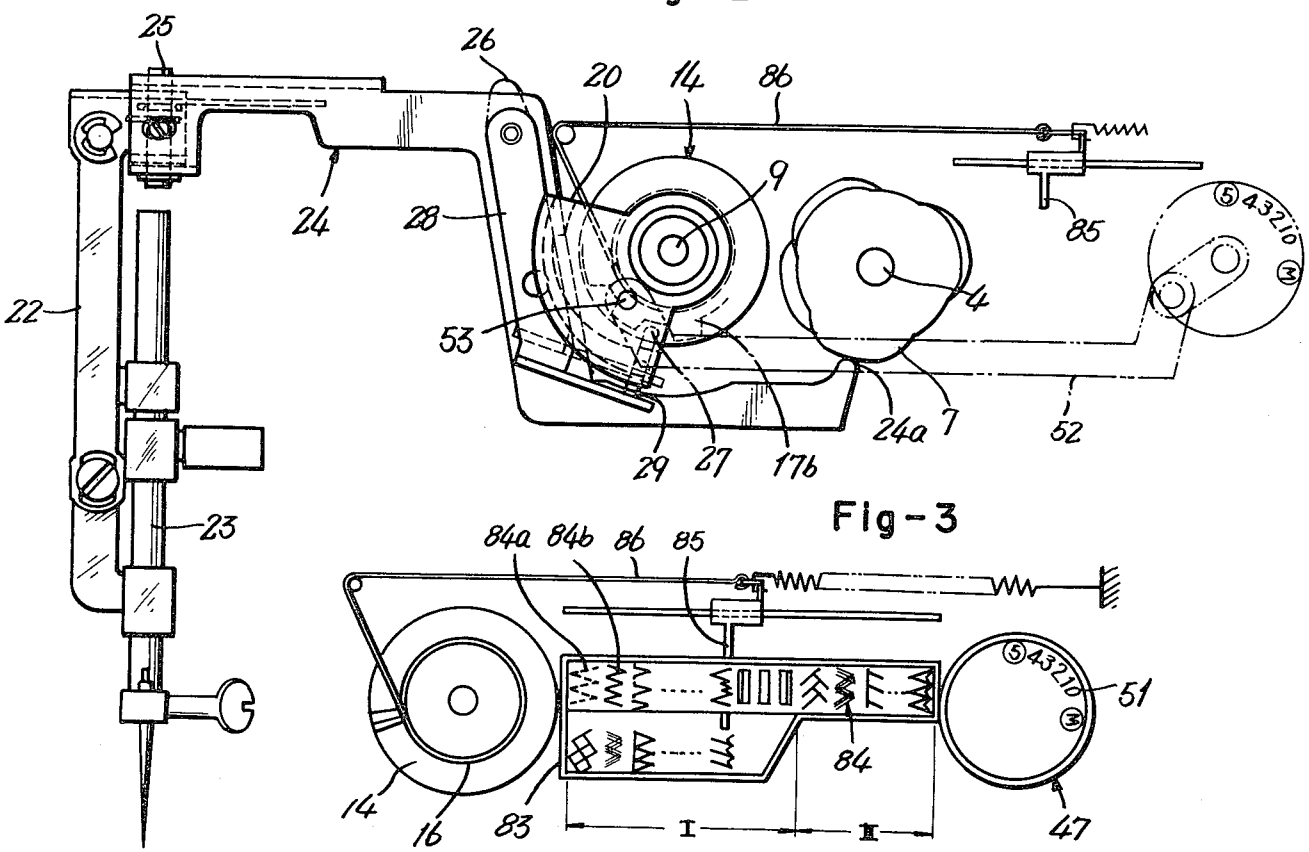
FIG. 2 shows a front view of a portion of the above.
FIG. 3 shows an explanatory view of the relationship between one part of the mechanism shown in FIG. 2 and a pattern indicating device.

The numeral 83 (FIG. 3) is a pattern indicating panel secured to a front face of the machine housing 2, displaying the stitch patterns as figures 84 (84*a*, 84*b* . . . ) to be selected by rotation of the pattern selecting dial 10. 85 is an indicator of selected patterns laterally moving by means of an appropriate means, e.g., a string 86 which is connected one end to the outer periphery of the winding drum 16, to a position of the stitch pattern corresponding to the rotating position of the drum.

Above described device will operate as follows. FIG. 7 shows that in the first rotation range (the range "I" in FIG. 3) of the pattern selecting dial 10, the minimum equal diameter portion 71*d* of the pattern switching cam 71*c* of the feed dial 71 is engaged with the follower 77*a* of the pattern switching arm 77. In this condition, since the follower 34 of the switching arm 32 engages the maximum radius cam groove 18*a* of the super pattern selecting cam 18, the switching arm 32 is maintained at the left-most position, and the super pattern feeding pawl 39 moves the follower 39*b* toward a cam 8*a* of the feed adjusting cam group 8 due to the contact of the support face 31*b* of the super pattern switching cam body 31 with the projection 39*a* of the pawl 39. At this time, since the cam 8*a* and the follower 39*b* are separated, the action of the cam 8*a* does not influence the feed adjustor 56. Therefore, the feeding amount can be manually set by the rotation of the feed dial 71. In this case, the rotation of of the feed dial 71 is limited only to the range where the follower 77*a* of the pattern switching arm 77 engages the minimum equal dialeter part 74*d* of the pattern switching cam 71*c* of the feed dial 71. The amplitude of the needle bar 23 is controlled in that the amplitude dial 47 is appropriately rotated to change the engaging position of the follower 29 of the amplitude control arm 28 with respect to the amplitude control cam face 20*a* of the amplitude control cam body 20.

The cylindrical cam face 17*b* of the pattern selecting cam 17 is provided to engage, during selecting a cam from the pattern cam group 7, the follower 27 of the selection adjusting arm 26 with the cam face thereof and temporarlily separating the follower 24*a* of the needle bar swinging arm 24 from the outer diameter of the pattern cam group 7.

Figure 7:
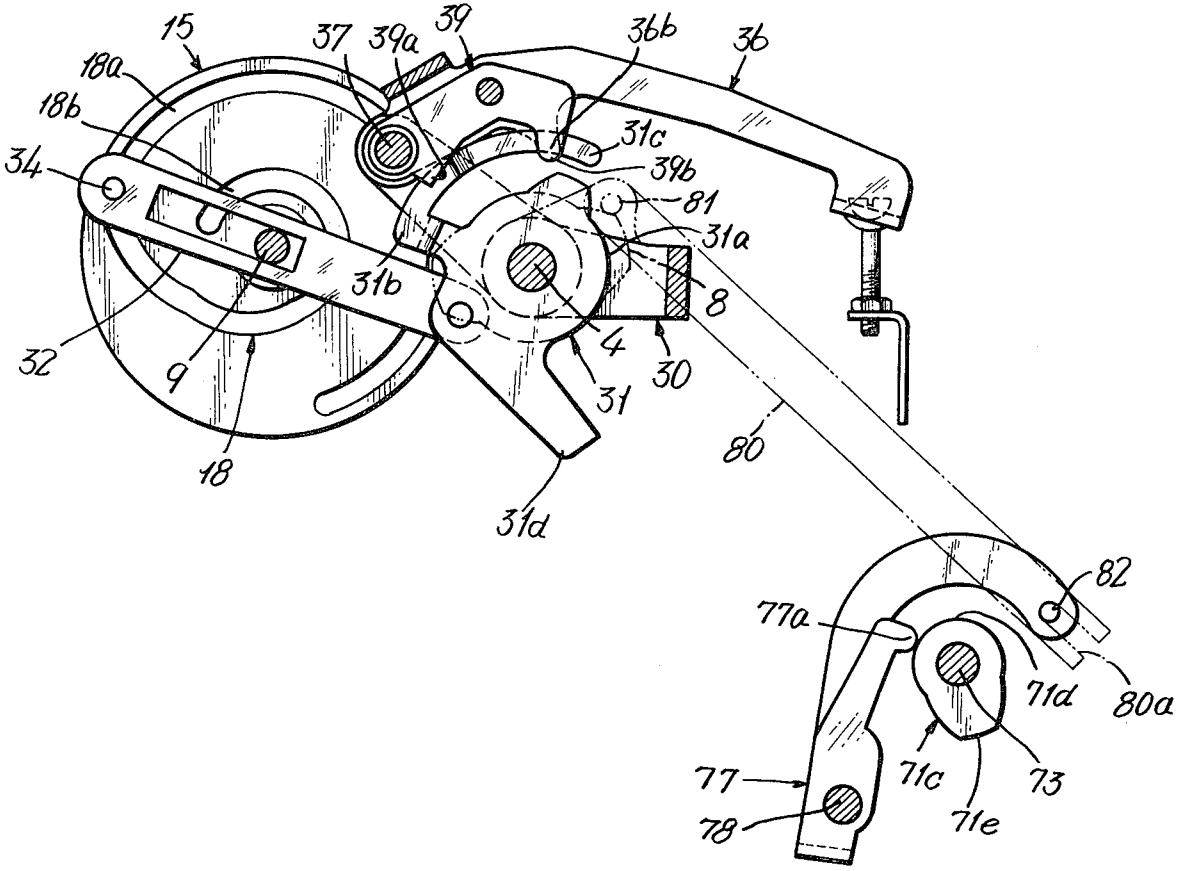
FIGS. 7 to 9 show explanatory views of actuation of relative mechanism.
Figure 8:
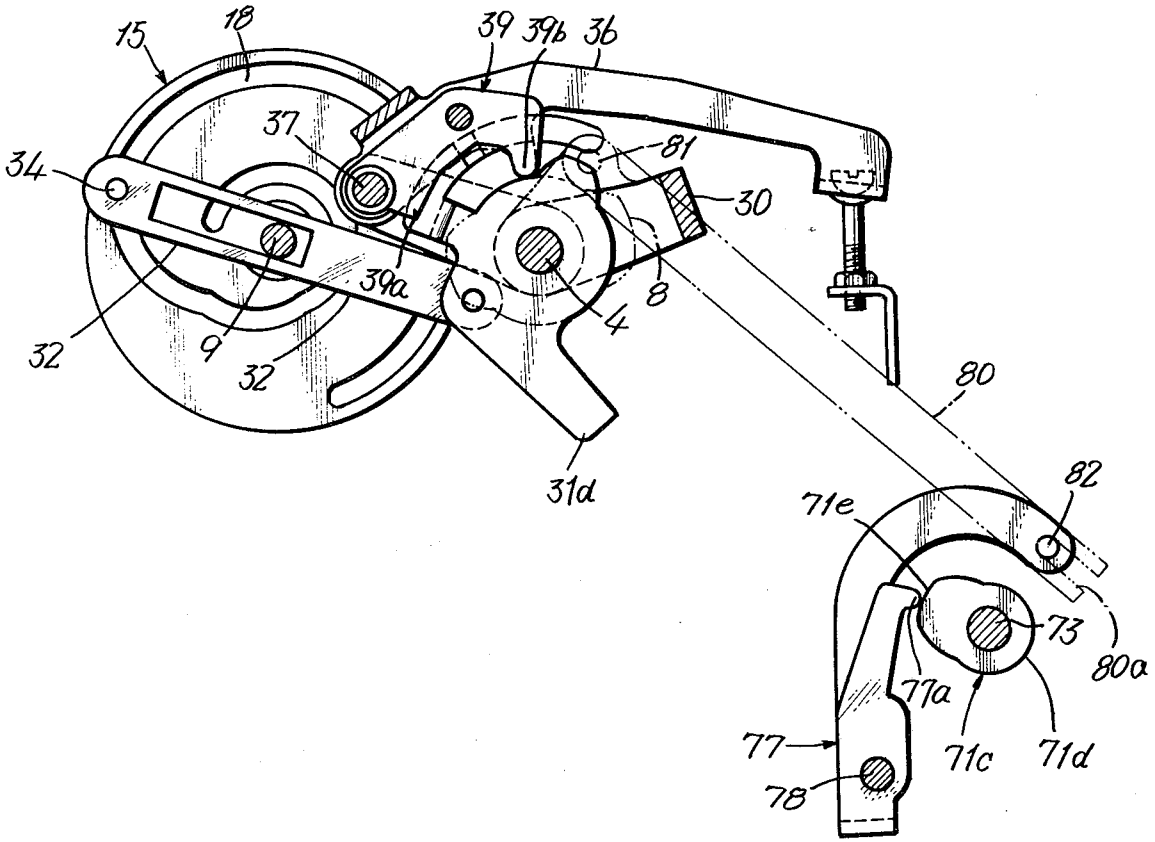

FIG. 8 shows similarly to FIG. 7 that in the first rotation range of the pattern selecting dial 10, the feed dial 71 is rotated from the position shown in FIG. 7 in order to engage the follower 77*a* of the pattern switching arm 77 with the maximum lift part 71*e* of the pattern switching cam 71*c*, and the pattern switching arm 77 is further rotated in the counterclockwise direction than shown in FIG. 7 and the super pattern selecting arm 30 is also rotated in the counterclockwise direction in correspondence with said rotation via the super pattern selecting rod 80, so that the follower 39*b* of the super pattern feeding pawl 39 is engaged with the cam 8*a* of the feed adjusting cam group 8, and the feeding amount is automatically set by the displacing amount of the cam 8*a*. Thus, the so-called super pattern stitch is formed.

Figure 9:
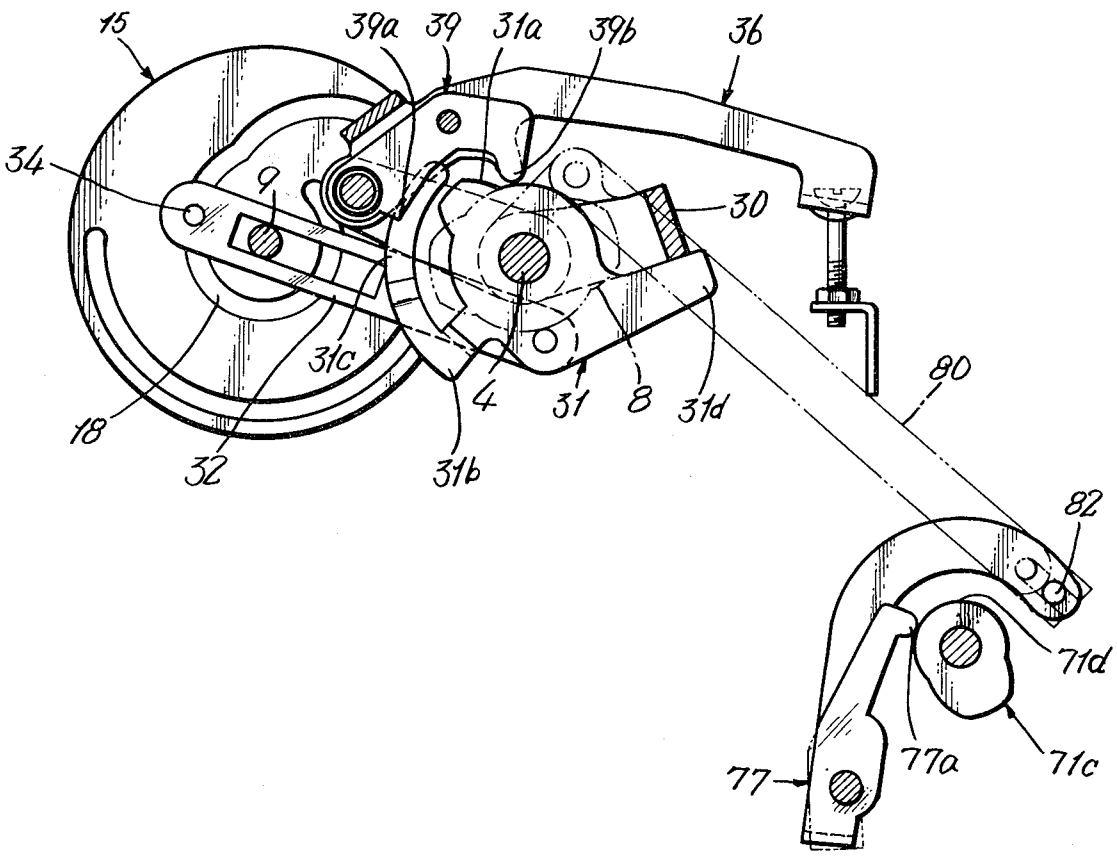

When the pattern selecting dial 10 is switched from the first rotation range to a second rotation range (the range "II" in FIG. 3), the follower 34 of the switching arm 32 engages the small radius cam face 18*b* of the super pattern selecting cam 18, as shown in FIG. 9 so that the switching arm 32 is moved to the right-most position, and the super pattern switching cam body 31 is rotated in the counterclockwise direction in correspondence with said movement, and the projecting piece 39*a* of the super feeding pawl 39 contacts the support face 31*c* of the super pattern switching cam body 31 by way of the guide face 31*d*, due to the action of the compression spring 42 and engages the cam 8*b* of the feed adjusting cam group 8, and concurrently the super pattern selecting arm 30 is also rotated in the counterclockwise direction by the angular portion of the super pattern switching cam body 31, and the follower 39*b* of the super pattern feeding pawl 39 engages the cam 8*b*. Thus, the super pattern stitch is formed. In this case, it is necessary to to adjust the feeding device by turning the feed control dial 71 to provide a permissible feeding amount greater than the maximum feeding amount of the super pattern so as to avoid interference of the rotating parts.

The projecting cam 31*a* of the super pattern switching cam body 31 is provided to engage, during selecting of a cam of the feed adjusting cam group 8, the follower 36*b* of the feed adjusting arm 36 with the cam face thereof and temporalily separate the follower 39*b* of the super pattern feeding pawl 39 from the outer diameter of the feed adjusting cam group.

As mentioned above and according to the present invention, the selecting positions of all the patterns to be selected are not prepared during one turning of the pattern selecting dial 10 as in the prior art. This dial is turned more than one time. Within the first range of rotation of the dial only the straight stitch and the zigzag stitches can be selected. Within the second range of rotation, the straight stitch and the zigzag stitches which have been selected at the same phase during the first range of rotation are not changed in the amplitude, but the super stitches in which the fabric feed as varied at a fixed cycle for various stitches are formed. In addition, the super stitches of the straight stitch and the zigzag stitches at the same phase may be formed even within the first range of rotation of the dial 10 by rotating the feed dial 71 which is provided with the feed adjusting cam selecting device, i.e., the pattern switching arm engaging the pattern switching cam provided at the feeding dial which controls obliquity of the feed adjustor, the super pattern selecting arm associating with said arm and pivoting the super pattern feeding pawl, and the feeding dial. Therefore, the present invention may carry out various kinds of the stitch patterns by simple operation of the feed dial.

We claim:

1. In a sewing machine, a combination comprising a housing; a driven shaft rotatably mounted in said housing; a group of pattern cams and two adjacent feed changing cams mounted on said driven shaft for rotation therewith; a second shaft parallel to said driven shaft turnably mounted in said housing; a pattern selecting dial fixed to said second shaft for manually turning the same between a plurality of first angular positions and a plurality of second angular positions following said first position; a needle bar having a longitudinal axis and extending substantially normal to the axes of said shafts; a needle bar support mounted on said housing and supporting said needle bar for reciprocation along its axis and for movement transverse thereto; an amplitude control cam, a pattern selecting cam and a feed setting disc cam mounted on said second shaft for turning therewith; means connected to said needle bar support and having an end adapted to engage one of said pattern cams, said means cooperating with said amplitude control cam for moving said needle bar support in said transverse direction and cooperating with said pattern selecting cam so that depending on the angular position on which said second shaft is turned, said end will engage a selected one of said pattern cams; a feed adjuster tiltably mounted on a shaft extending transverse to said second shaft; manually operable pattern switch cam means having a smaller diameter portion and a larger diameter portion; a super pattern feed pawl having an end adapted to engage one of said feed changing cams; support means freely tiltably mounted on said first shaft and supporting said super pattern feed pawl; a pattern switch arm having a follower engaging said pattern switching cam means; means connecting said pattern switch arm to said support means for maintaining said end of said super pattern feed pawl out of engagement with any feed changing cam when said follower engages said small diameter portion of said pattern switching cam means and for engaging said end of said super pattern feed pawl with one of said feed changing cams when said follower engages said larger diameter portion of said pattern switching cam; and means cooperating with said feed setting disc cam for aligning in any of said first angular positions of said pattern selecting dial said super pattern feed pawl with said one feed changing cam and for aligning in any of said second angular positions of said pattern selecting dial said super pattern feed pawl with the other of said feed changing cams while engaging said end of said pawl with said other feed changing cam even when said follower engages said small diameter portion of said pattern switching cam means.

2. A combination as defined in claim 1, wherein said amplitude cam has an amplitude control cam face and said pattern selecting cam has on one side a stepped cam face inclined in axial direction, and wherein said means connected to said needle bar support comprises a needle bar turning arm, the free end of which is adapted to engage one of said pattern cams and a pair of follower means connected to said turning arm and respectively engaging said control cam face of said amplitude control cam and said stepped cam face of said pattern selecting cam.

3. A combination as defined in claim 1, wherein said feed setting disc cam is provided with a spirally extending cam groove having an inner small diameter portion and an outer large diameter portion, and wherein said means cooperating with said feed settling disc cam comprise a super pattern switching cam tiltably mounted on said first shaft, a switching arm provided with an elongated slot through which said second shaft extends, a follower on one end of said switching arm extending in said cam groove of said feed setting disc cam, the other end of said switching arm being pivotally connected to said super pattern switching cam.

4. A combination as defined in claim 3, wherein said super pattern switching cam has a circumferentially extending cam portion having two axially offset cam faces with an inclined guide face therebetween respectively adapted to engage a portion of said super pattern feed pawl.

5. A combination as defined in claim 1, and including operator controlled means for changing the angular position of said amplitude control cam independent of the angular position of said pattern selecting dial.

6. A combination as defined in claim 1, and including means fixed to said housing and cooperating means on said pattern selecting dial for releasably holding the latter in selected angular positions.

7. A combination as defined in claim 1, wherein said support means comprises a U-shaped member having a short arm and a long arm, said means connecting said pattern switching arm to said support means comprises an elongated rod pivotally connected at one end to said short arm and engaging with a forked opposite end a pin laterally projecting from said pattern switching arm, said super pattern feed pawl being pivotally mounted in the region of said free end of said long arm, said pattern cams and said feed changing cams being located between said short and said long arm of said U-shaped member.

* * * * *